United States Patent [19]

Bessette

[11] Patent Number: 4,942,978

[45] Date of Patent: Jul. 24, 1990

[54] PROTECTIVE LINER FOR CONTAINERS

[76] Inventor: David M. Bessette, 808 Linden St., Cleveland, Wis. 53015

[21] Appl. No.: 342,298

[22] Filed: Apr. 24, 1989

Related U.S. Application Data

[63] Continuation-in-part of Ser. No. 282,651, Dec. 12, 1988, abandoned.

[51] Int. Cl.[5] ..... B54G 5/00

[52] U.S. Cl. ..... 220/470; 220/403; 220/461

[58] Field of Search ..... 220/470, 400, 403, 5 A, 220/461

[56] References Cited

U.S. PATENT DOCUMENTS

| | | | |
|---|---|---|---|
| 3,083,858 | 4/1963 | Biedenstein | 220/265 |
| 3,088,617 | 5/1963 | Krautkramer | 215/250 |
| 3,167,209 | 1/1965 | Jones | 220/403 X |
| 3,187,966 | 6/1965 | Klygis | 220/265 X |
| 3,272,373 | 9/1966 | Alleaume et al. | 220/426 |
| 3,346,101 | 10/1967 | Pestka | 220/426 X |
| 4,239,416 | 12/1980 | Borca et al. | 220/403 X |
| 4,261,474 | 4/1981 | Cohen | 215/250 |
| 4,453,875 | 6/1984 | Johnson, Sr. | 220/461 |
| 4,456,136 | 6/1984 | Palsson | 215/330 X |
| 4,458,820 | 7/1984 | Abrams | 215/250 X |
| 4,534,477 | 8/1985 | Laub, III | 215/330 X |
| 4,552,166 | 11/1985 | Chadbourne, Sr. et al. | 220/461 X |
| 4,646,926 | 3/1987 | Agbay et al. | 215/250 X |
| 4,673,102 | 6/1987 | Bullock, Jr. | 220/5 A X |
| 4,736,859 | 4/1988 | Mayes et al. | 215/330 |
| 4,799,597 | 1/1989 | Mayes et al. | 215/250 |

*Primary Examiner*—Steven M. Pollard

*Attorney, Agent, or Firm*—Francis J. Bouda

[57] ABSTRACT

A liner is described for containers such as fluid tanks, gasoline tanks, and tank trucks and railroad tank cars. The liner is a thick flexible membrane styled, shaped and arranged to fit closely within the inside and against the inside wall of the container, and the liner has a plurality of flexible tubular ribs therein. The tubular ribs are filled with a material such as foamed polyurethane or other fluid under pressure, and when the tubes are filled they hold the liner against the interior wall of the container, even though the container is empty.

3 Claims, 2 Drawing Sheets

PROTECTIVE LINER FOR CONTAINERS

This patent application is a continuation-in-part of U.S. patent application Ser. No. 282,651 filed Dec. 12, 1988, now abandoned.

The present invention is directed particularly to protective liners for large fluid tanks, such as the immobile types which may be installed above or below the ground, but also for the transportable types which are part of the over-the-road semi-trailers. The size of the tank is not material, but is generally intended for large containers holding 1,000 gallons or more. Moreover, it is particularly adaptable for containers intended for highly corrosive liquids, but also may be used in conjunction with other pourable materials such as grain and pellets.

Most fluid containers of the type considered in this invention are steel tanks which, over a period of time, may become corroded as a result of the fluids stored therein, or because of the rusting action of the exterior elements (ground water, rain, etc.).

Some of these tanks are relatively expensive, particularly the "tank-trucks" which are pulled by the tractor-trailer combination seen on the highways.

If the material stored in such containers is highly corrosive, the life expectancy of the tank is relatively short and thus it becomes not only extremely expensive for replacement, but also highly dangerous for people and to the environment in the event that the tanks leak or are ruptured, or somehow fail to retain the contents and leak the contents into the ground (if the tanks are subterranean), into the ground if they are above-the-ground storage tanks, or to the passing public if the tanks are over-the-road type moved along the highways. Needless to say, the liner of the present invention may also be used on or in marine vessels, such as massive oil tankers, as well as in railroad tank cars.

Although others have tried to solve this problem, and I refer particularly to Chadbourne U.S. Pat. No. 4,552,166; Borca U.S. Pat. No. 4,239,416; Monk U.S. Pat. No. 4,408,628 and Yurkoski U.S. Pat. No. 3,687,087, all have failed to provide a liner which inexpensively and satisfactorily solves the problem as does the liner of the present invention.

Many of the devices prior to the present invention have attempted merely to insulate the contents of the tank against changes in temperature, and some have provided means to support the liner within the tank. None, however, have, as satisfactorily as the present invention, provided for means to prevent the liner from collapsing within an empty tank as the contents thereof are evacuated, combined with an arrangement which permits the liner to be inserted into a defective tank so as to render usable and reclaimable an expensive instrument which, under other circumstances, would have to be discarded.

SUMMARY OF THE INVENTION

The liner of the present invention is a heavy-duty flexible membrane which may be made of plastic or rubber or other suitable material, cut to shape and formed into an integral member by adhesive, heat seal, vulcanization, dielectric, welding or otherwise secured together to form the size and configuration of the interior of the container which is to be lined thereby. Tunnel or tubular portions are formed therein at various locations to provide a rib network which is filled with a rigidifying foam material during the installation thereof. Appropriate boots and flanges are welded in place to accommodate the matching manways, inlets, outlets, vents, etc., and the completed construction fits snugly against the interior wall of the container, without collapsing, even though the container may be empty.

Therefore, an object of the present invention is to provide an inexpensive protective liner for a container, the installation of which can be easily and inexpensively accomplished.

Another object of the present invention is to provide a container-liner with integral means to prevent the liner from collapsing when the container is emptied of its contents.

A further object is to provide a container-liner which can be constructed and arranged to fit within containers having a variety of shapes such as cylindrical, rectangular, tubular, transportable, subterranean, and open-top as well.

With the above and other objects in view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organizations of the instrumentalities as herein shown and described.

In the drawings, wherein like reference characters indicate like parts:

Figure 1:
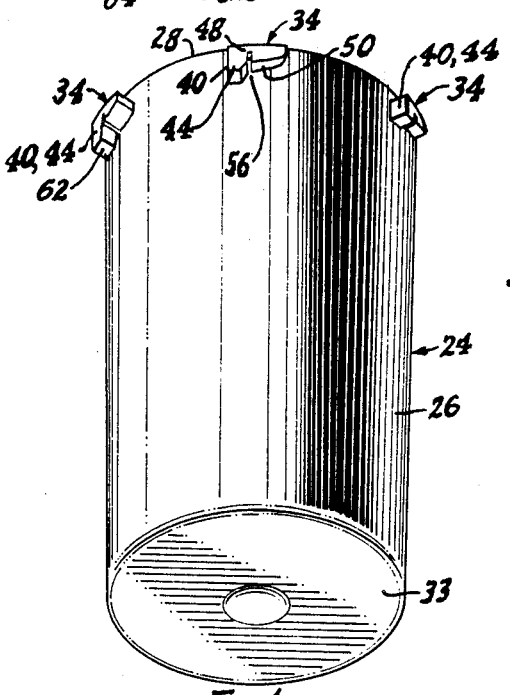
FIG. 1 is a perspective schematic view of a cylindrical tank liner of the present invention having a circular cross-section. This, of course, may be oval or angular.
Figure 4:
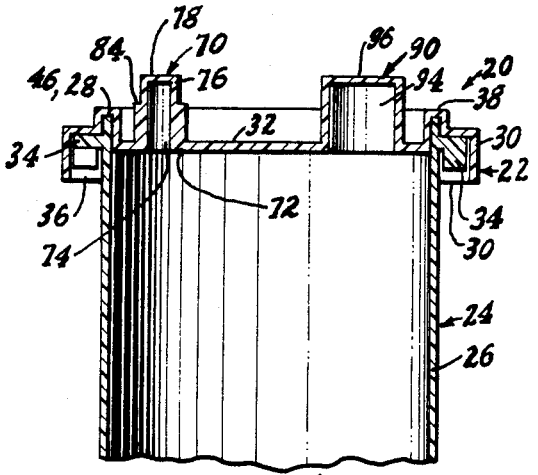
FIG. 4 is a schematic perspective view showing a rib construction when the liner is disposed for horizontal use.

Referring now to FIG. 1, there is shown a cylindrical liner 20 which consists of a thick-gauge membrane. This membrane may be polypropylene or synthetic rubber, or any similar material of fairly thick material such as polyvinylchloride (PVC), or polyethylene or other polymer material such as a fluoropolymer. A preferred material is a chemically inert sheet-material known as FLUOROLINE, (a trade-mark of the F. C. Witt Associates of Coal City, Ill. and which is a 20-mil thick sheet. Also usable for this purpose is GEOLAST 40, another trademark of the F. C. Witt company, which is rubber compound. ELVALINE (polyethylene) and EXCELINE (pvc), also products of the F. C. Witt company have also been found to be suitable materials.

The desirable thickness of these materials depends to a certain extent on the material itself, but will generally be in the range of 0.020 to 0.250 inches.

The liner 20 may be fabricated from a number of sheets of the flexible membrane which are cut to shape and there after secured together, as described earlier, to form the size and configuration needed. Additional strips 21 are welded at various locations to provide hollow tubes or ribs 22, as is shown particularly in FIGS. 2, 3 and 6.

Figure 5:
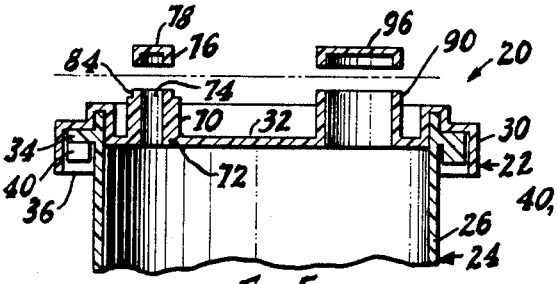
FIG. 5 is a perspective schematic view similar to FIG. 4 but showing the disposition of the liner when intended for vertical use.
Figure 9:
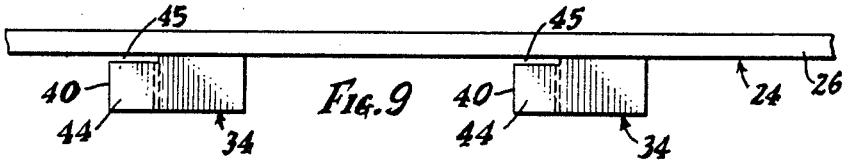
FIG. 9 is a perspective schematic view similar to FIG. 8 for use with a modified form of open-top container.
Figure 11:
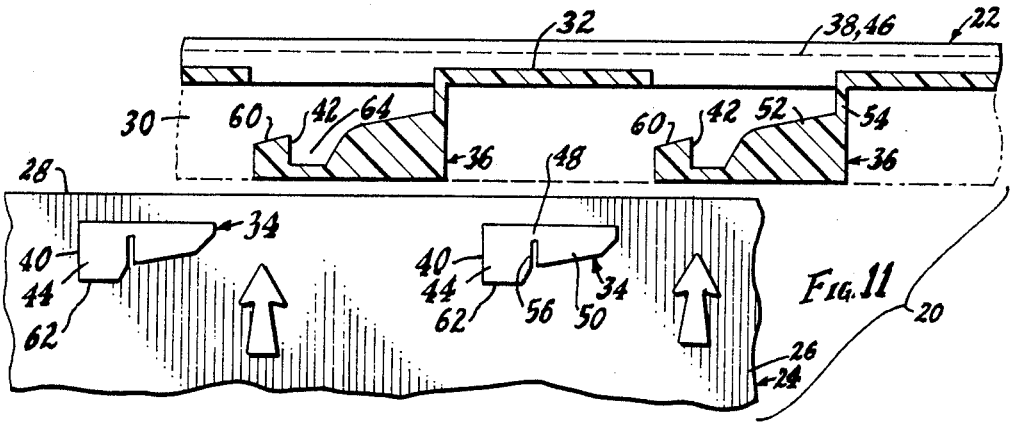
FIG. 11 is a perspective schematic view showing how the liner of the present invention can be adapted for containers of special and varying shapes.

These ribs may be formed circumferentially as is shown particularly in FIG. 1, but may also be longitudinally disposed, as at the end 23 in FIG. 1 or the sides 24 in FIG. 5 or peripherally at 25 in FIG. 9, or 26 in FIG. 11.

Figure 2:
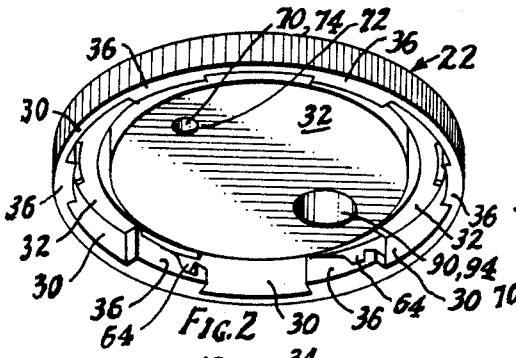
FIG. 2 is a section taken generally along line 2—2 of FIG. 1 showing a full rib construction.
Figure 3:
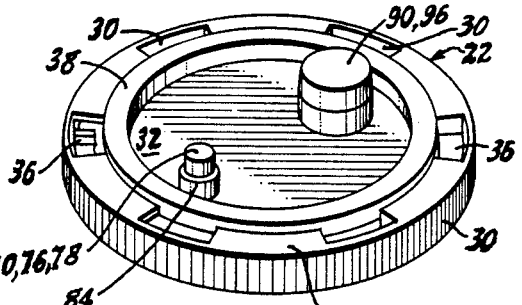
FIG. 3 is a section similar to FIG. 2 showing a partial rib construction.
Figure 6:
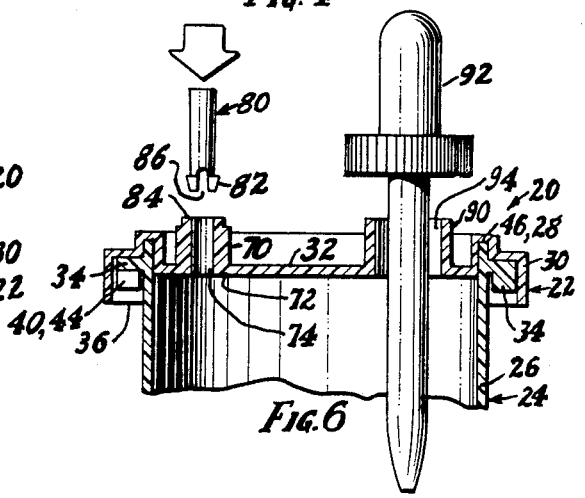
FIG. 6 is a cross-sectional view taken generally along line 6—6 of FIG. 2, prior to filling of the rib.
Figure 13:
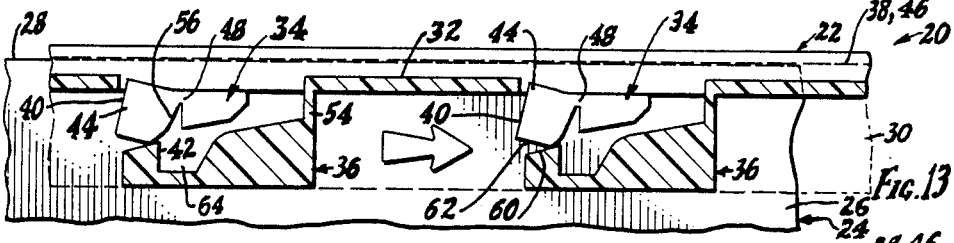
FIG. 13 is a fragmentary cross-sectional view, similar to FIGS. 6 and 7, illustrating an additional means and method of rigidifying the liner.
Figure 14:
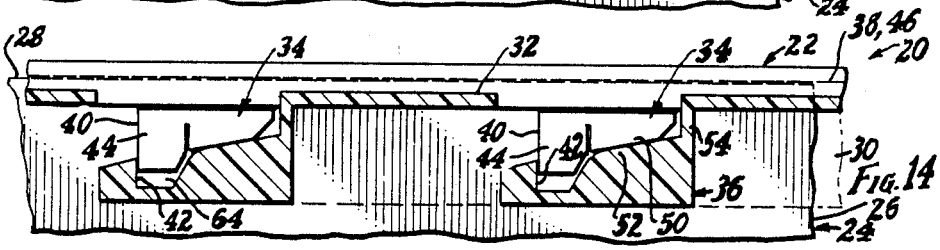
FIG. 14 is a cross-sectional view through a tank liner, similar to that shown in FIG. 12, illustrating more clearly the rigidifying member shown in FIG. 13.
Figure 1:
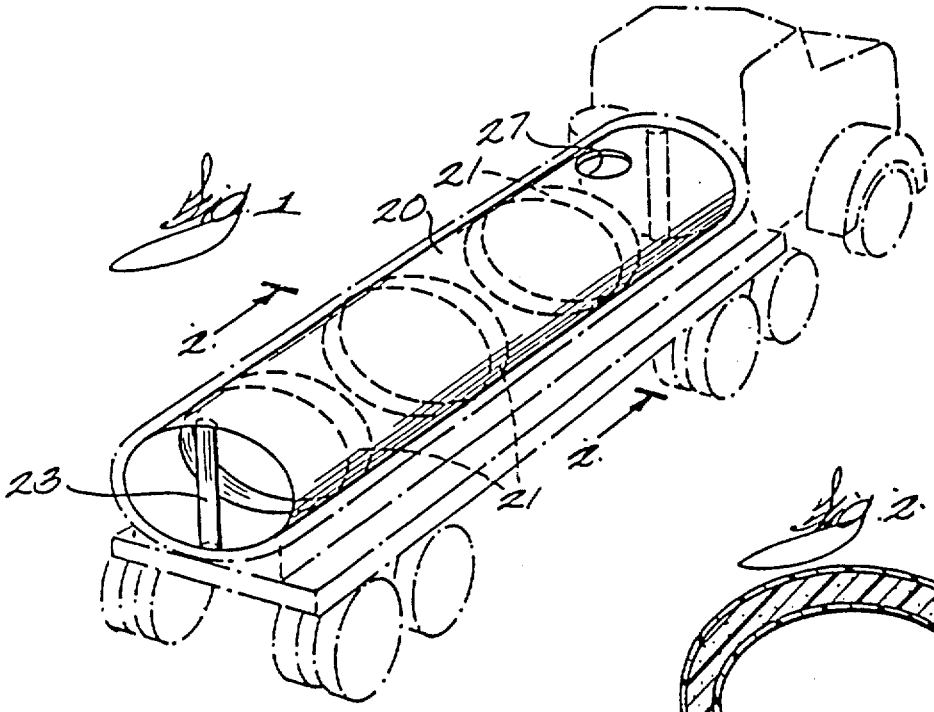
Figure 2:
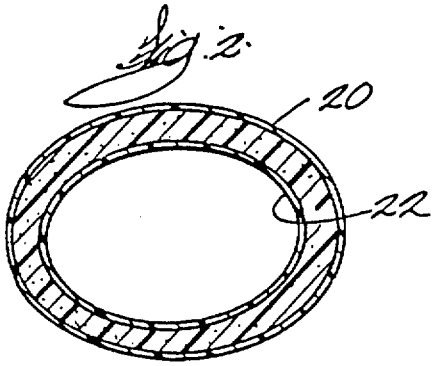
Figure 4:
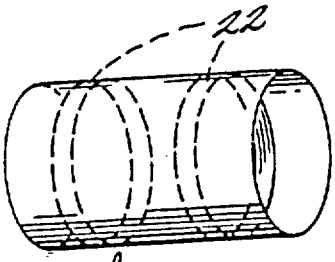
Figure 3:
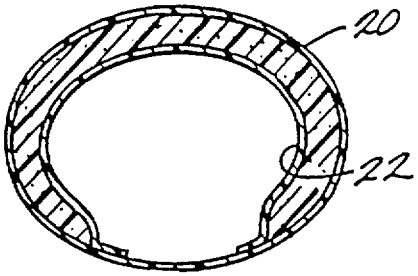
Figure 5:
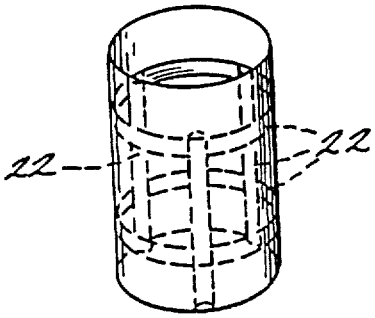
Figure 12:
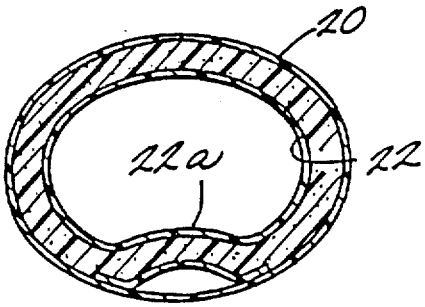

The tubes or ribs 22 shown in FIGS. 2, 3 and 6 may be modified by providing a separate tube, such as that shown at 30 in FIGS. 13 and 14, held securely in place against the liner 20 by a plurality of straps or loops or fastening members 31. The rigidifying tube 30 differs from the tubes or ribs 22, only insofar as it does not require a portion of the liner 20 to form a portion of the tube. The tubes 30 may be held in place by the straps or loops 31, which include a portion 32, which wrap around the tube and by the portions 33 which provide feet or anchoring members which are securely fastened to the inner-wall of the liner 20, as is shown particularly in FIGS. 13 and 14.

In a fully closed liner for a fully-closed container, a manway or aperture or port 27 may be formed in the liner membrane 20, with appropriate boots or flanges (not shown) welded in place to accommodate the matching manways, inlets, outlets, vents, etc., of the container to be lined.

As is shown particularly in FIG. 3, the ribs may be formed partially circumferentially or as is shown in FIG. 2 as a full circumferential structure.

Figure 8:
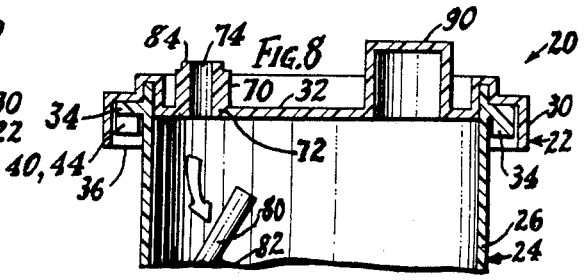
FIG. 8 is a perspective schematic view of a liner used with an open top container.

Additionally, as is shown particularly in FIGS. 5, 8 and 9, the ribs may be linear rather than curved, so as to hold the liner in place in vertical position.

Additionally, the ribs may be formed as part of the periphery or lip of an open-ended container, as shown in FIG. 11, and because of the unique construction of the liner of the present invention, can be adapted to a variety of shapes and outlines.

After the configuration of the interior of the container to be lined has been determined and the membranes cut and shaped and appropriately secured together, the entire liner is rolled and folded for compact and easy insertion through a manway or doorway. Once the liner is inside the tank, a person can climb inside the tank and unfold and arrange the liner for exact placement. Of course, while an individual is inside the tank, appropriate ventilation and fresh air must be supplied.

Once the liner is laid out on the bottom of the container, the workman will attach an inflation coupler to the manway or flange and then position all of the ports for appropriate installation.

Thereafter, inflation of the liner is accomplished by passing compressed air within the liner, the workman, previously in the tank between the inside of the tank wall and the liner, then crawls into the liner as it begins to inflate and rise.

Once inside the liner, he observes and controls the liner for positioning and makes any final adjustments and positioning necessary so that the liner will fit properly within the container. After this is accomplished and the liner is completely inflated, a pressure of 1–3 PSI should be maintained to keep the liner pressed against the interior walls of the container, and also to provide appropriate ventilation while the workman completes all inlet and outlet vents and manway connections.

After such connections are secured, the rib network can be filled with a foam plastic such as urethane. Starting at one end of the tank, the workman inserts the urethane gun nozzle into a rib tube and fills it until the ribs are approximately 80% filled, drawing the injection tube out of the rib gradually during the filling procedure. Once one rib is completely filled, the remaining ribs can be injected and filled in the same manner. This is repeated in sequence until all of the ribs have been injected.

Figure 7:
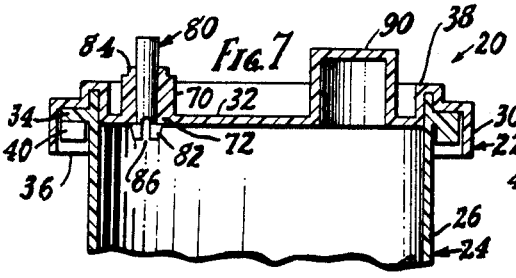
FIG. 7 is a cross-sectional view similar to FIG. 6 after the rib has been filled.

The hardening of the urethane foam within the ribs thus creates a rigidifying ring or rib as is shown in FIG. 7 so the liner can thus be held against the interior wall of the container without any liquid or fluid pressure inside the liner.

Figure 12:
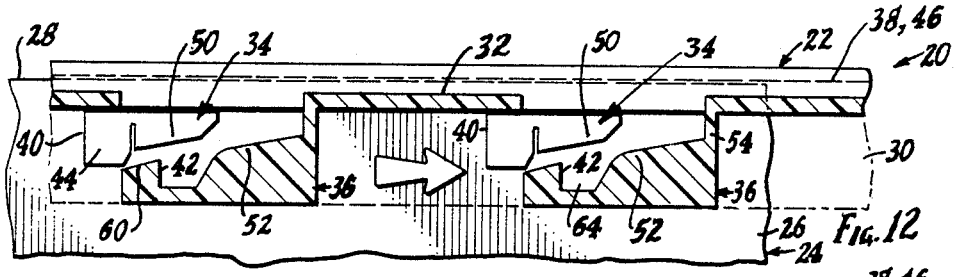
FIG. 12 is a view similar to FIG. 2 but showing how the ribs may be formed with a "bridge" at the bottom to permit fluid to pass beneath the rib for complete drainage of tanks.

As is shown particularly in FIGS. 12 and 14, the rigidifying ring or rib 22 or 30 has a slight deformation (22-*a*) in that area which will be most adjacent the lowermost portion of the container. This deformation or "bridge" 22-*a* separates the rib tube 22 from the liner so that any fluid in the bottom of the container will flow beneath the bridges of the ribs to that end of the container where a drain hole or port is installed for total drainage of the container.

The last step is to seal the injection port openings at each rib so as to insure against any tank fluid migration, and after all of the sealing is completed and thoroughly cured, the outside blower providing air pressure and ventilation may be removed and the tank is ready for service.

The rib network, filled with foam, will now act as the sole support for the liner when the tank is not totally filled. The liner is the corrosion barrier needed for most chemical materials and to combat against further deterioration and oxidation.

It is to be understood that the present invention may be embodied in other specific forms without departing from the spirit or special attributes hereof, and it is therefore desired that the present embodiments be considered in all respects as illustrative, and therefore not restrictive, reference being made to the appended Claims rather than to the foregoing description to indicate the scope of the invention.

Having thus described my invention, what I claim as new and desire to protect by Letters Patent are the following:

1. In a flexible fluid-tight liner for a container, a flexible membrane forming a first material shaped to fit into close contact with the interior surface of the container, a plurality of tubes each held in close proximity to the flexible membrane, said tubes being inflatable and filled with material under pressure whereby each of said tubes forms a stiffening rib or ring which then holds the first membrane against the interior wall of the container even when the 2. The liner of claim 1 wherein said tubes are inflated with compressed fluid.

3. The liner claim 1 wherein said tubes are inflated with a material which solidifies after injection into the said tubes

* * * * *

UNITED STATES PATENT AND TRADEMARK OFFICE

CERTIFICATE OF CORRECTION

PATENT NO. : 4,942,978

DATED : Jul. 24, 1990

INVENTOR(S) : David M. Bessette

It is certified that error appears in the above-identified patent and that said Letters Patent is hereby corrected as shown below:

The title page showing the illustrative figure, should be deleted to appear as per attached title page.

The sheets of drawings should be deleted to be replaced with the two (2) sheets of drawings as shown on the attached sheets.

Signed and Sealed this

Seventeenth Day of September, 1991

*Attest:*

HARRY F. MANBECK, JR.

*Attesting Officer*

*Commissioner of Patents and Trademarks* nited States Patent [19]

isette

[11] Patent Number: 4,942,978

[45] Date of Patent: Jul. 24, 1990

PROTECTIVE LINER FOR CONTAINERS

Inventor: David M. Bessette, 808 Linden St., Cleveland, Wis. 53015

Appl. No.: 342,298

Filed: Apr. 24, 1989

Related U.S. Application Data

] Continuation-in-part of Ser. No. 282,651, Dec. 12, 1988, abandoned.

] Int. Cl.[5] ..... B54G 5/00

] U.S. Cl. ..... 220/470; 220/403; 220/461

] Field of Search ..... 220/470, 400, 403, 5 A, 220/461

5] References Cited

U.S. PATENT DOCUMENTS

| | | | |
|---|---|---|---|
| 3,083,858 | 4/1963 | Biedenstein | 220/265 |
| 3,088,617 | 5/1963 | Krautkramer | 215/250 |
| 3,167,209 | 1/1965 | Jones | 220/403 X |
| 3,187,966 | 6/1965 | Klygis | 220/265 X |
| 3,272,373 | 9/1966 | Alleaume et al. | 220/426 |
| 3,346,101 | 10/1967 | Pestka | 220/426 X |
| 4,239,416 | 12/1980 | Borca et al. | 220/403 X |
| 4,261,474 | 4/1981 | Cohen | 215/250 |
| 4,453,875 | 6/1984 | Johnson, Sr. | 220/461 |
| 4,456,136 | 6/1984 | Palsson | 215/330 X |
| 4,458,820 | 7/1984 | Abrams | 215/250 X |
| 4,534,477 | 8/1985 | Laub, III | 215/330 X |
| 4,552,166 | 11/1985 | Chadbourne, Sr. et al. | 220/461 X |
| 4,646,926 | 3/1987 | Agbay et al. | 215/250 X |
| 4,673,102 | 6/1987 | Bullock, Jr. | 220/5 A X |
| 4,736,859 | 4/1988 | Mayes et al. | 215/330 |
| 4,799,597 | 1/1989 | Mayes et al. | 215/250 |

*Primary Examiner*—Steven M. Pollard
*Attorney, Agent, or Firm*—Francis J. Bouda

[57] ABSTRACT

A liner is described for containers such as fluid tanks, gasoline tanks, and tank trucks and railroad tank cars. The liner is a thick flexible membrane styled, shaped and arranged to fit closely within the inside and against the inside wall of the container, and the liner has a plurality of flexible tubular ribs therein. The tubular ribs are filled with a material such as foamed polyurethane or other fluid under pressure, and when the tubes are filled they hold the liner against the interior wall of the container, even though the container is empty.

3 Claims, 2 Drawing Sheets

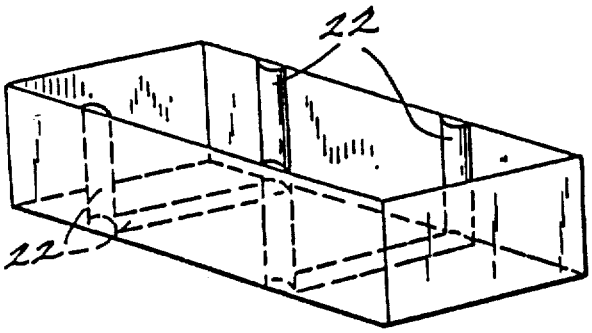

Figure 10:
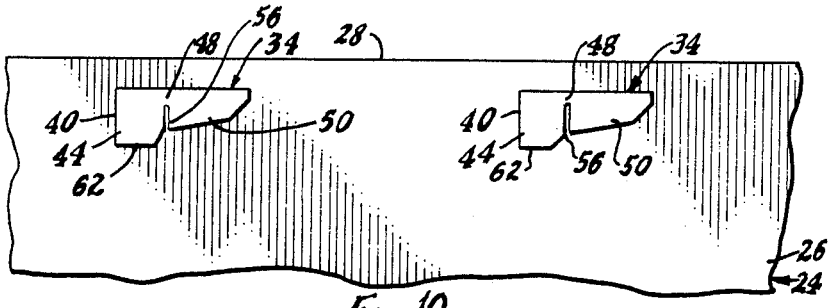
FIG. 10 is a perspective schematic view of a liner for use with an open-end container.

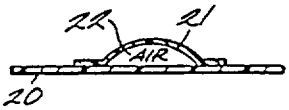
Fig. 6
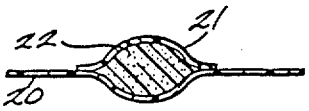
Fig. 7
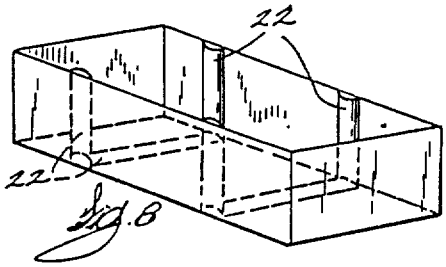
Fig. 8
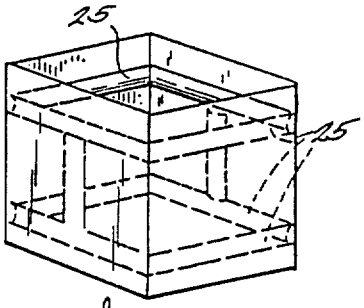
Fig. 9
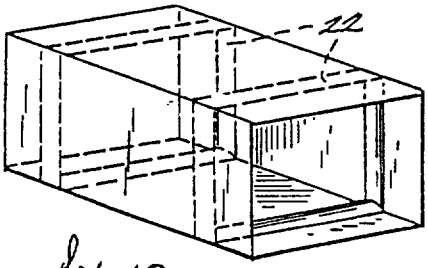
Fig. 10
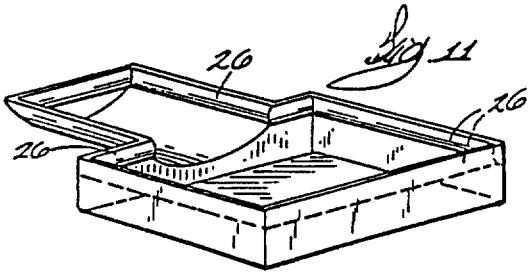
Fig. 11
Fig. 14
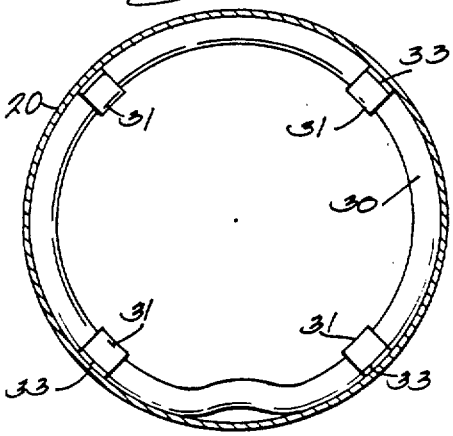
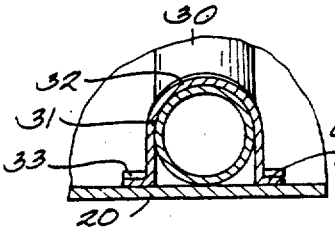
Fig. 13